United States Patent [19]

Woodruff

[11] 4,182,365

[45] Jan. 8, 1980

[54] CONTROL VALVE FOR USE WITH VARIABLE DISPLACEMENT PISTON PUMP

[75] Inventor: Frank Woodruff, New Hartford, N.Y.

[73] Assignee: The Bendix Corporation, Teterboro, N.J.

[21] Appl. No.: 836,264

[22] Filed: Sep. 26, 1977

[51] Int. Cl.[2] ..... F16K 31/363

[52] U.S. Cl. ..... 137/494; 137/505.15; 417/213

[58] Field of Search ..... 137/505.15, 505.22, 137/494, 505.14, 505.18, 484.8, 505.42, 116.5, 101; 91/412; 60/424, 484, 422; 417/213

[56] References Cited

U.S. PATENT DOCUMENTS

| | | | |
|---|---|---|---|
| 1,067,233 | 7/1913 | Adams | 137/494 X |
| 1,579,940 | 4/1926 | Iversen | 137/494 X |
| 2,756,771 | 7/1956 | Spencer | 137/494 |
| 3,321,173 | 5/1967 | Seger | 137/505.22 X |
| 3,675,678 | 7/1972 | Lamping | 137/505.22 |

*Primary Examiner*—William R. Cline
*Attorney, Agent, or Firm*—Anthony F. Cuoco

[57] ABSTRACT

For use with a variable displacement piston pump of the type including a hydrostatic bearing for transmitting a thrust load for affecting the pump output, a valve responsive to pump discharge manifold pressure for controlling the pressure in the pump chamber, and including means for insuring that the full thrust load will be taken by the hydrostatic bearing at discharge pressures less than a predetermined pressure.

4 Claims, 1 Drawing Figure

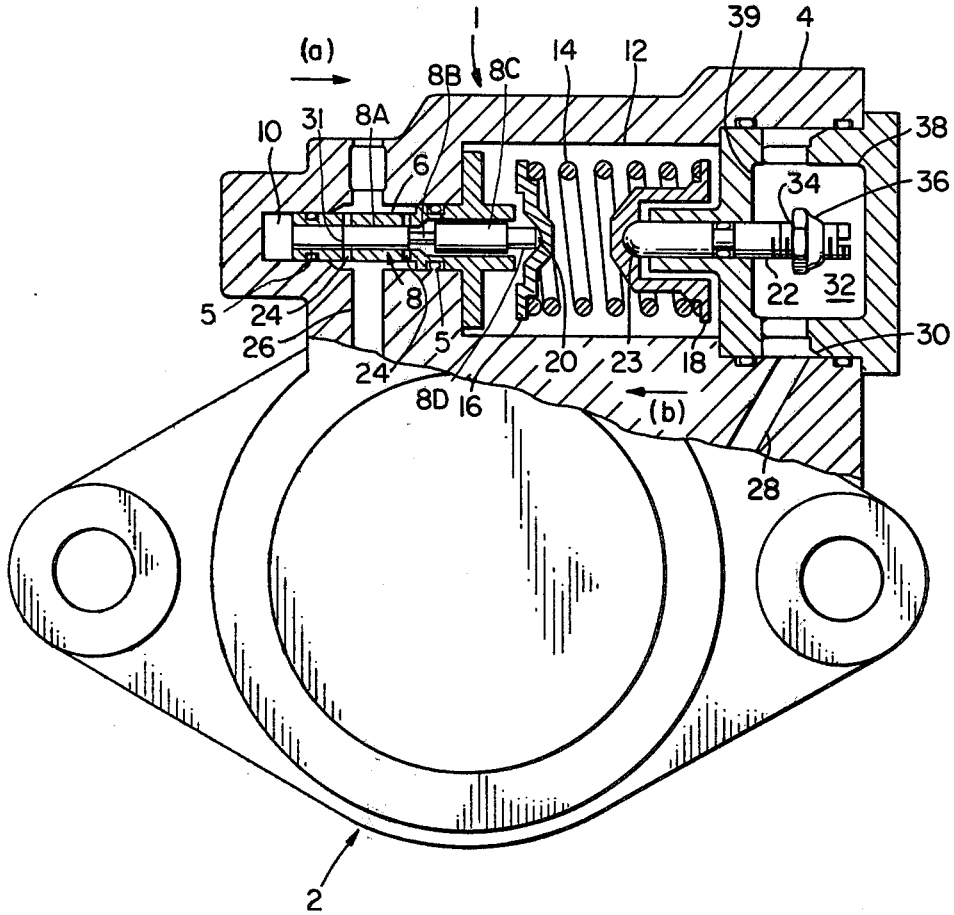
1
39
4
(a)
14
12
8B
8C
10
31
8A
38
6
34
36
22
32
5
24
8
26
5
30
24
20
23
18
8D
16
(b)
28
2

CONTROL VALVE FOR USE WITH VARIABLE DISPLACEMENT PISTON PUMP

BACKGROUND OF THE INVENTION

Cross Reference To Related Applications

The valve disclosed herein is a modification of the valve disclosed in commonly assigned copending U.S. application Ser. No. 794,774, now abandoned, and may be used in conjunction with a variable displacement piston pump includina a hydrostatic thrust bearing such as disclosed in commonly assigned copending U.S. application Ser. No. 835,623, filed by Frank Woodruff on Sept. 22, 1977, now U.S. Pat. No. 4,137,013.

Field of the Invention

This invention relates generally to pressure control valves for piston pumps and, particularly, to a valve which controls the discharge manifold pressure of the pump to provide a pressure for regulating the stroke of the pump pistons.

Description of the Prior Art

The aforenoted U.S. Pat. No. 4,137,013 describes a variable displacement piston pump including a shaft journalled in a casing by ball bearings at its driven and driving ends. The driving end of the shaft supports a swash plate to pivot about an axis displaced from the center line of the shaft and preferably, but not necessarily, normal thereto. A plurality of pistons having hollow cylinders extending therethrough are arranged with corresponding check valves in a pump block. During the "delivery" stroke of the pistons the pressure in the cylinders become sufficient to actuate the check valves whereby fluid is delivered to a common discharge manifold.

When the manifold pressure approaches a predetermined value, a force is created which is transmitted through a hydrostatic thrust bearing arrangement to the swash plate and pivots the plate away from a maximum flow position. The pistons are arranged with the swash plate so that when the swash plate pivots, the stroke of the pistons is decreased to reduce fluid flow and pressure. Equilibrium is thus established and a reduced fluid flow at a predetermined substantialy constant pressure is maintained. A valve is used in conjunction with a pump of the type described to control the pump discharge manifold pressure for providing a proportional control pressure which creates the force transmitted to the swash plate.

In the valve described in the aforenoted U.S. application Ser. No. 794,774, a spool is responsive to pump discharge pressure for being displaced against a spring preload. If such a valve were to be used with a pump including a hydrostatic thrust bearing as described in the aforenoted U.S. Pat. No. 4,137,013, at discharge manifold pressures less than a predetermined pressure the spring preload would not be overcome, whereby zero pressure would develop in the valve control pressure discharge conduit. This would permit the full thrust load to be taken by the pump shaft driven end ball bearing. While an adequate ball bearing could be provided for very short transient periods, an alternative is desirable. The valve described herein provides this alternative by featuring an arrangement which permits higher discharge pressures without resizing the ball bearing for some particular pressure.

SUMMARY OF THE INVENTION

This invention contemplates a piston pump pressure control valve including a hollow valve housing having a spring disposed therein. At start-up conditions the pump discharge pressure and the proportional control pressure provided by the valve are substantially zero. As the discharge pressure increases a valve spool is displaced. The spring is completely extended and exerts no force. The displacement of the valve spool uncovers a port, whereupon the control pressure increases and is ducted to the pump to actuate the pump pistons as heretofore noted and is ducted to a valve piston which is displaced by the control pressure for compressing the spring in opposition to the displacement of the spool. The spool and piston continue to be displaced as the discharge and control pressures increase until a predetermined adjustable pressure is attained.

One object of this invention is to provide a pressure control valve for a variable displacement piston pump of the type including a hydrostatic thrust bearing, which features structure for insuring that the full thrust load to the pump is applied to the hydrostatic bearing.

Another object of this invention is to provide a valve of the type described which includes a spool displaced in response to pump discharge manifold pressure for providing a control pressure proportional to the discharge pressure for actuating the pump.

Another object of this invention is to provide a valve of the type described including a spring responsive to the control pressure ducted back to the valve for compressing a spring to oppose to displacement of the spool as the discharge and control pressures simultaneously increase until a predetermined pressure is attained.

The foregoing and other objects and advantages of the invention will appear more fully hereinafter from a consideration of the detailed description which follows taken together with the accompanying drawing wherein one embodiment of the invention is illustrated by way of example. It is to be expressly understood, however, that the drawing is for illustration purposes only and is not to be construed as defining the limits of the invention.

DESCRIPTION OF THE DRAWING

With reference to the Drawing, a pump pressure control valve designated generally by the numeral 1 is shown arranged with a pump housing designated generally by the numeral 2. The pump may be of the type including a hydrostatic thrust bearing as described in the aforenoted U.S. Pat. No. 4,137,013.

Valve 1 includes a housing 4 which may be integral with pump housing 2 and has an axially disposed sleeve 6 with a valve spool 8 disposed therein; sleeve 6 is sealed in housing by O-rings 5. Spool 8 has portions 8A, 8B, 8C, and 8D. A port 10 is in communication with a pump discharge manifold pressure conduit for receiving the pump discharge pressure, the same being described in the aforenoted U.S. Application Ser. No. 794,774. Port 10 is in communication with valve sleeve 6.

Valve housing 4 includes a substantially hollow portion 12. Disposed within hollow portion 12 is a coil spring 14 (shown fully extended) captured between a Spring follower 16 and a displaceable cup member 18 rested within the spring. Spring follower 16 is adjacent and end 20 of spool 8. A piston 22 has an end 23 adjacent the bottom of cup 18 so that the cup is displaced with the piston as will hereinafter be described.

Sleeve 6 includes ports 24 in communication with a control pressure discharge conduit 26. Control pressure discharge conduit 26 leads to pump 2 for actuating the pump pistons through a hydrostatic thrust bearing arrangement as described in the aforenoted U.S. Pat. No. 4,137,013. The control pressure circulates through the pump and is discharged therefrom through a conduit 28 in communication with conduit 26 and transmitted back to valve 4 through an inlet port 30.

Inlet port 30 is in communication with a chamber 32 which receives the transmitted control pressure. Piston 22 includes a threaded portion 34 carrying an adjustable nut 36 for purposes which will be hereinafter described. It is to be noted that the arrangement of bore 9, spool 8, ports 24 and conduit 26 are in many respects similar to the arrangement described in the aforenoted U.S. application Ser. No. 794,774.

Operation of the Invention

With the specific structural details of valve 1 illustrated and described with reference to the Drawing, the operation of the valve will next be described.

Under start-up conditions, for example, the pump discharge pressure received at port 10 and the control pressure applied to the pump through conduit 28 are substantially zero. As the pump discharge pressure increases, it acts on end 31 of spool 8 urging the spool rightward as indicated by arrow (a) in the Drawing. Spring 14 is completely extended and exerts no force.

As spool 8 is urged rightward, ports 24 are uncovered and a control pressure is generated which is ducted to the pump through conduit 26 for actuating the pump pistons as heretofore noted. The control pressure is ducted through the pump and outward therefrom through conduit 28 and port 30 to chamber 32.

The control pressure thereupon transmitted to chamber 32 displaces piston 22 which, in turn, displaces cup member 18 leftward as indicated by arrow (b) in the Drawing, thereby compressing spring 14 so that the spring exerts a force in opposition to the displacement of spool 8.

The arrangement is such that spool 8 continues to be displaced rightward while piston 22 continues to be displaced leftward as the discharge and control pressures simultaneously increase. Upon the displacement reaching a predetermined value corresponding to a predetermined control pressure, and edge 39 of chamber 38 contacts nut 5 to prevent further displacement. The value of the predetermined displacement may be adjusted by adjusting nut 36 on the threaded portion of piston 22.

It will now be understood from the aforegoing description of the invention that the arrangement described accommodates conditions of substantially zero pressure that may develop in conduit 26. This would permit the full thrust load developed to be taken by the ball bearing supporting the driven end of the pump shaft. While this condition may be tolerated for short transient periods by using an adequate bearing, it is highly undesirable on a long term basis. The alternative described insures that under such zero pressure conditions, spring 14 will be extended and the load thereon will be essentially zero so that valve spool 8 will be free to uncover ports 24 whereby a control pressure will be generated for transmission to the hydrostatic thrust bearing of the pump, and also transmitted back to the valve to compress spring 14, whereby a higher discharge pressure will be required to displace spool 8.

Although but a single embodiment of the invention has been illustrated and described in detail, it is to be expressly understood that the invention is not limited thereto. Various changes may also be made in design and arrangement of the parts without departing from the spirit and scope of the invention as the same will now be understood by those skilled in the art.

What is claimed is:

1. A valve responsive to an input pressure from a pressure utilizing means for applying an output pressure to the pressure utilizing means, comprising:

a valve housing having a sleeve longitudinally disposed therein and extending into a substantially hollow housing portion;

resilient means disposed within the hollow housing portion;

spool means displaceably disposed within the sleeve and having one end adjacent one end of the resilient means;

piston means supported to extend longitudinally into the hollow housing portion and having one end adjacent an opposite end of the resilient means;

a first input pressure channel longitudinally disposed within the housing, with a first input pressure from the utilizing means being received therethrough for acting on an opposite end of the spool means;

an output pressure channel extending radially through the sleeve and the housing for transmitting an output pressure from the valve to the utilizing means;

a second input pressure channel extending radially through the housing, with a second input pressure from the utilizing means being received therethrough for acting on an opposite end of the piston means;

the spool means covering the output pressure channel and the resilient means being fully extended when the first input pressure is substantially zero;

the spool means being displaced in one sense against the force of the fully extended resilient means acting on the one end of the spool means upon an increase in the first input pressure acting on the opposite end of the spool means for uncovering the output pressure channel whereby a valve output pressure is provided thereat;

the valve output pressure being circulated through the output pressure channel to the pressure utilizing means for providing the second input pressure which is applied through the second input pressure channel and acts on the opposite end of the piston means for displacing the piston means in an opposite sense, with the one end of the piston means compresing the resilient means in opposition to the displacement of the spool means;

means for limiting the displacement of the piston means including a longitudinally extending chamber in communication with the second pressure input channel for receiving the pressure applied therethrough;

the opposite end of the piston means extending into the chamber and carrying a displacement limiting member; and the piston means being displaced by the second input pressure within the chamber from one end thereof to the opposite end, with the piston displacement being limited when the displacement limiting member is adjacent the opposite end of the chamber.

2. A valve as described by claim 1, wherein the displacement limiting member includes:

the opposite end of the piston means extending into the chamber having a threaded portion; and a nut is adjustably carried on the threaded portion, and the piston means displacement is limited when the nut is adjacent the opposite end of the chamber.

3. A valve as described by claim 2, wherein:

the nut is adjustable on thee threaded portion of the piston member for adjusting the displacement limit of the piston means.

4. A valve as described by claim 1, wherein:

the resilient means includes a coil spring longitudinally disposed within the hollow housing portion, a spring follower member adjacent one end of the coil spring and a cup member nested within the opposite end of the coil spring;

the spool means having the one end adjacent the spring follower member; and the piston means having the one end adjacent the cup member.

* * * * *